US012655839B2

(12) United States Patent
Harris et al.

(10) Patent No.: US 12,655,839 B2
(45) Date of Patent: Jun. 16, 2026

(54) SIGNAL DISTRIBUTION DEVICE FOR A FLUID PUMP

(71) Applicant: SPM Oil & Gas Inc., Fort Worth, TX (US)

(72) Inventors: Ralph Harris, Fort Worth, TX (US); Reid Young, Keller, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/947,428

(22) Filed: Nov. 14, 2024

(65) Prior Publication Data

US 2026/0132781 A1 May 14, 2026

(51) Int. Cl.

| | |
|---|---|
| ***F04B 51/00*** | (2006.01) |
| ***E21B 43/26*** | (2006.01) |
| ***E21B 47/06*** | (2012.01) |
| ***F04B 49/06*** | (2006.01) |
| ***F04B 49/10*** | (2006.01) |

(52) U.S. Cl.

CPC ..... *F04B 51/00* (2013.01); *E21B 43/2607* (2020.05); *E21B 47/06* (2013.01); *F04B 49/06* (2013.01); *F04B 49/10* (2013.01); *F04B 2201/00* (2013.01); *F04B 2201/0201* (2013.01); *F04B 2201/0204* (2013.01); *F04B 2203/0202* (2013.01); *F04B 2207/048* (2013.01)

(58) Field of Classification Search

CPC combination set(s) only.

See application file for complete search history.

(56) References Cited

U.S. PATENT DOCUMENTS

| | | | | |
|---|---|---|---|---|
| 7,298,206 | B2 | 11/2007 | Pickerd et al. | |
| 7,545,152 | B2 | 6/2009 | Grund | |
| 7,783,446 | B2 | 8/2010 | Amstutz et al. | |
| 9,516,256 | B2 | 12/2016 | White | |
| 10,274,520 | B2 | 4/2019 | Pickerd et al. | |
| 2002/0145415 | A1 | 10/2002 | Vanremmen | |
| 2008/0060846 | A1* | 3/2008 | Belcher | E21B 47/06 175/25 |
| 2014/0017092 | A1* | 1/2014 | Brackel | F04B 47/02 417/18 |
| 2015/0253459 | A1* | 9/2015 | Aldridge | G01V 3/38 702/7 |

(Continued)

FOREIGN PATENT DOCUMENTS

| | | | |
|---|---|---|---|
| CN | 107864154 | B | 12/2023 |
| WO | WO-2014/048799 | A2 | 4/2014 |
| WO | WO-2015/117844 | A1 | 8/2015 |

*Primary Examiner* — Binh Q Tran

(57) ABSTRACT

A monitoring system for a hydraulic fracturing pump may include a sensor configured to output a signal based on measurements of a fluid parameter relating to the hydraulic fracturing pump, where the signal has a fixed relationship to a measurement scale. The monitoring system may include a first data receiver and a second data receiver configured to derive the measurements of the fluid parameter using the measurement scale. The monitoring system may include a signal distribution device, without external power, coupled to the sensor, the first data receiver, and the second data receiver. The signal distribution device may be configured to distribute respective input signals to the first data receiver and to the second data receiver, where the respective input signals are based on the signal and have the fixed relationship to the measurement scale.

20 Claims, 3 Drawing Sheets

(56) References Cited

U.S. PATENT DOCUMENTS

| | | | | |
|---|---|---|---|---|
| 2017/0167245 | A1* | 6/2017 | Dickenson | G01V 1/50 |
| 2019/0369276 | A1* | 12/2019 | Barfoot | G01H 9/004 |
| 2020/0393585 | A1* | 12/2020 | Jaaskelainen | E21B 47/135 |
| 2023/0132593 | A1* | 5/2023 | Fripp | E21B 33/12 166/281 |
| 2023/0147476 | A1* | 5/2023 | Wheelock | G01V 1/46 367/82 |

* cited by examiner

SIGNAL DISTRIBUTION DEVICE FOR A FLUID PUMP

TECHNICAL FIELD

The present disclosure relates generally to fluid pumps and, for example, to a signal distribution device for a fluid pump.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. A hydraulic fracturing pump used for hydraulic fracturing may be subjected to diagnostic monitoring involving measurement of various parameters of the hydraulic fracturing pump. For example, a discharge pressure of the pump may be measured for compliance with a particular operating range. Sometimes, multiple unrelated systems may utilize sensor measurements from the pump, which generally requires the use of respective sensors (and other associated components, such as gauge ports) for each of the systems. However, the use of multiple sensors introduces additional complexity and failure points on the pump.

The signal distribution device of the present disclosure solves one or more of the problems set forth above and/or other problems in the art.

SUMMARY

A monitoring system for a hydraulic fracturing pump may include a sensor configured to output a signal based on measurements of a fluid parameter relating to the hydraulic fracturing pump, where the signal has a fixed relationship to a measurement scale. The monitoring system may include a first data receiver and a second data receiver configured to derive the measurements of the fluid parameter using the measurement scale. The monitoring system may include a signal distribution device, without external power, coupled to the sensor, the first data receiver, and the second data receiver. The signal distribution device may be configured to distribute respective input signals to the first data receiver and to the second data receiver, where the respective input signals are based on the signal and have the fixed relationship to the measurement scale.

A signal distribution device for a hydraulic fracturing pump may include a first data port configured to couple to a sensor, a second data port configured to couple to a first data receiver, a third data port configured to couple to a second data receiver, and a signal processing component communicatively coupling the first data port to the second data port and the third data port. The signal processing component may include a resistor in a data path between the first data port and the second data port, a first stage differential amplifier configured to amplify a voltage difference across the resistor, and a second stage amplifier configured to amplify an amplified signal that is output by the first stage differential amplifier for outputting to the second data receiver.

A hydraulic fracturing system may include a fluid pump, a gauge port coupled to the fluid pump, and a sensor coupled to the gauge port and configured to output a signal based on measurements of a fluid parameter relating to the fluid pump. The hydraulic fracturing system may include a first data receiver and a second data receiver. The hydraulic fracturing system may include a signal distribution device coupled to the sensor, the first data receiver, and the second data receiver. The signal distribution device may be configured to distribute respective input signals to the first data receiver and to the second data receiver, where the respective input signals are based on the signal.

DETAILED DESCRIPTION

This disclosure relates to a signal distribution device, which is applicable to any system that utilizes a sensor for measuring one or more parameters of the system. For example, the signal distribution device may be used with a fluid pump, such a hydraulic fracturing pump of a hydraulic fracturing system.

Figure 1:
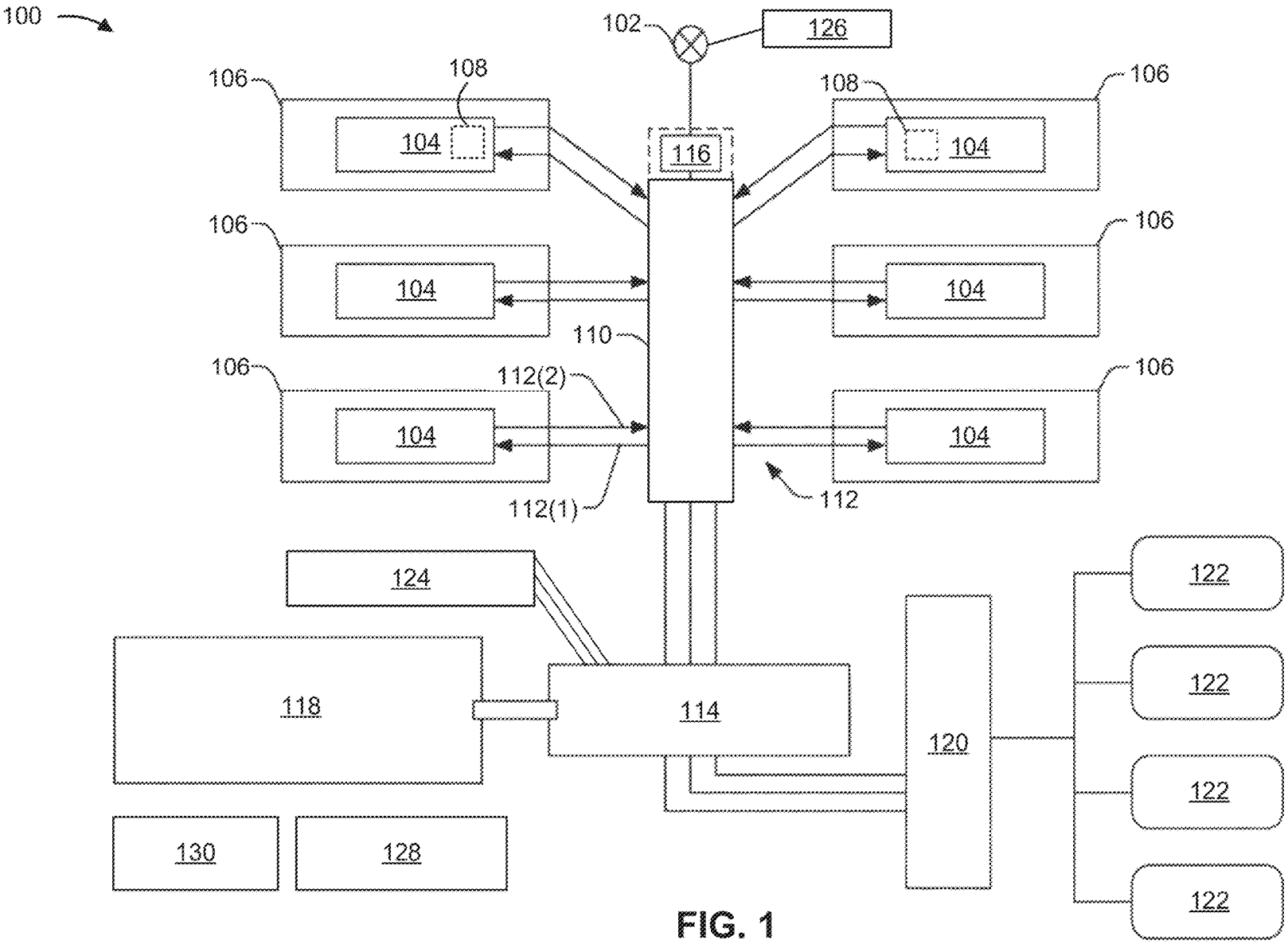
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100.

As indicated above, FIG. 1 is provided as an example. Other examples may differ from what is described with regard to FIG. 1.

Figure 2:
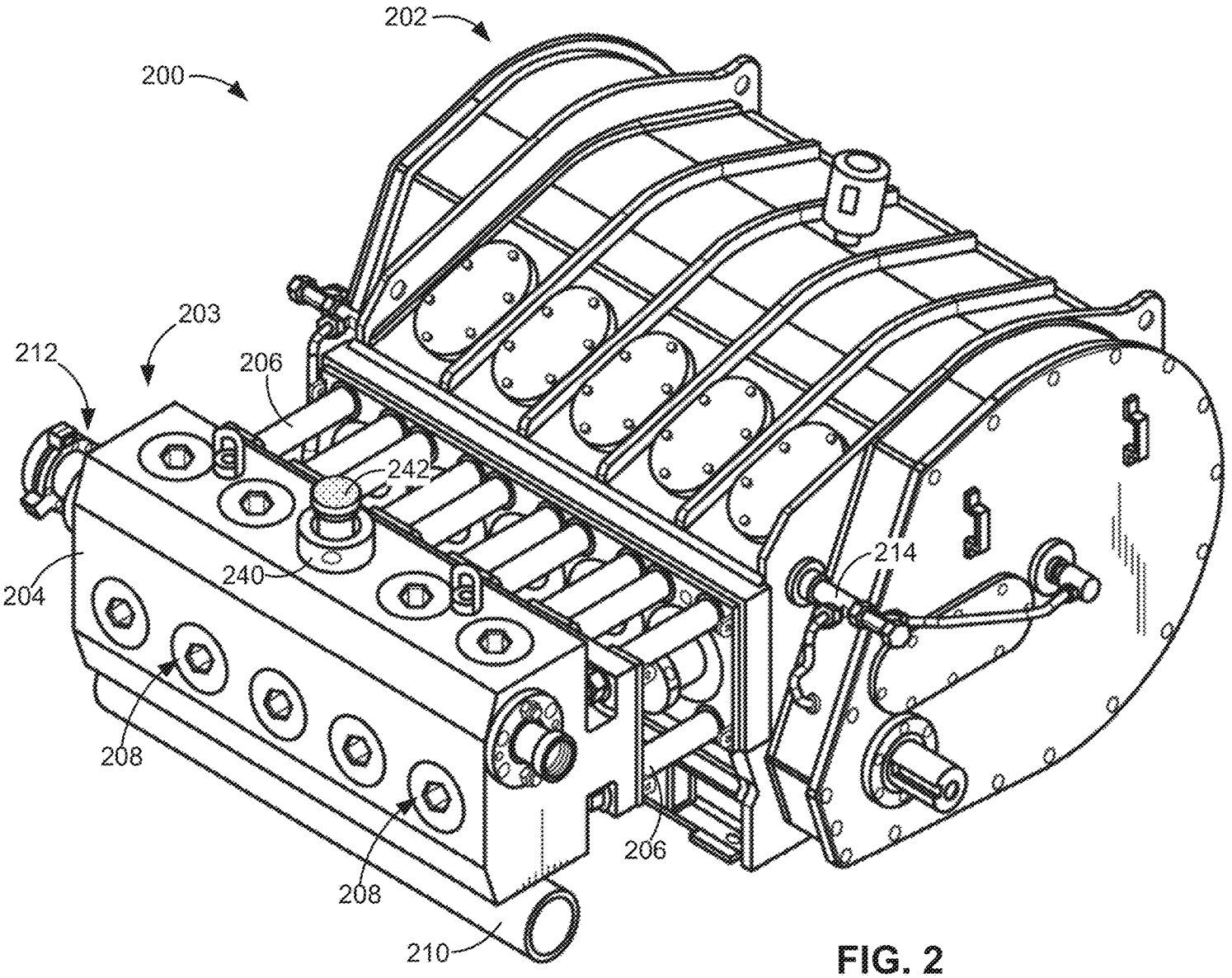
FIG. 2 is a perspective view of an example fluid pump.

FIG. 2 is a diagram illustrating a perspective view of an example fluid pump 200. The fluid pump 200 may correspond to a fluid pump 108 described in connection with FIG. 1. In some implementations, the fluid pump 200 may be mounted on a trailer to facilitate transportation of the fluid pump 200 between operational sites. The fluid pump 200 may be a reciprocating pump, as shown.

The fluid pump 200 includes a power end 202 and a fluid end 203 having a fluid end block 204. The fluid end 203 may be connected to the power end 202 by stay rods 206. The fluid end block 204 defines one or more fluid chambers 208 (shown as five fluid chambers 208 in FIG. 2). For example, the fluid pump 200 may include one, two, three, four, five, or more fluid chambers 208 and associated components.

As an example, each fluid chamber 208 may include a suction valve to control fluid suction into the fluid chamber 208, and a discharge valve to control fluid discharge from the fluid chamber 208. Each fluid chamber 208 may be associated with a plunger. During a suction stroke of the plunger, fluid is allowed to flow from a suction manifold 210 through the suction valve and into the fluid chamber 208. The fluid is then pumped in response to a discharge stroke (e.g., a forward stroke) of the plunger and flows through the discharge valve into a discharge manifold 212. The discharge manifold 212 may be fluidly coupled to a wellbore to supply high pressure fluid to the wellbore for fracturing rock formations and other uses. In operation, the plunger is driven by the power end 202 of the fluid pump 200. For example, the power end 202 may include a crankshaft that is rotated by a gearbox output. A gearbox input is coupled to a transmission and a power source, such as a diesel engine, to rotate the gearbox input during operation.

A gauge port 240 may be attached to the fluid pump 200. For example, the gauge port 240 may be attached to the power end 202 or to the fluid end 203 (e.g., to the fluid end block 204). As shown, the gauge port 240 may be attached to the fluid end block 204 in fluid communication with the discharge manifold 212, which facilitates measurement of a discharge pressure of the fluid pump 200. Alternatively, the gauge port 240 may be attached to the suction manifold 210 (e.g., to facilitate measurement of a suction pressure of the fluid pump 200), to another fluid passageway of the fluid end 203, to a fluid passageway of the power end 202 (e.g., a lubrication passageway, such as lubrication passageway 214, to facilitate measurement of an oil pressure or an oil temperature), or to another part of the power end 202 or fluid end 203 from which measurements relating to the fluid pump 200 can be collected.

The gauge port 240 is configured to provide a connection point for a sensor 242. Thus, the sensor 242 may be coupled to the gauge port 240, and the sensor 242 may be configured to collect, via the gauge port 240, measurements relating to a parameter (e.g., a fluid parameter) of the fluid pump 200. The parameter may be a discharge pressure of the fluid pump 200, a suction pressure of the fluid pump 200, an oil pressure of the fluid pump 200, or an oil temperature of the fluid pump 200 (e.g., in a lubrication passageway of the power end 202), among other examples. Thus, the sensor 242 may be a pressure sensor, a temperature sensor, or another type of sensor. The signal distribution device, as described further in connection with FIG. 3, enables multiple data receivers to receive measurements collected by a single sensor 242 coupled to a single gauge port 240.

As indicated above, FIG. 2 is provided as an example. Other examples may differ from what is described with regard to FIG. 2.

Figure 3:
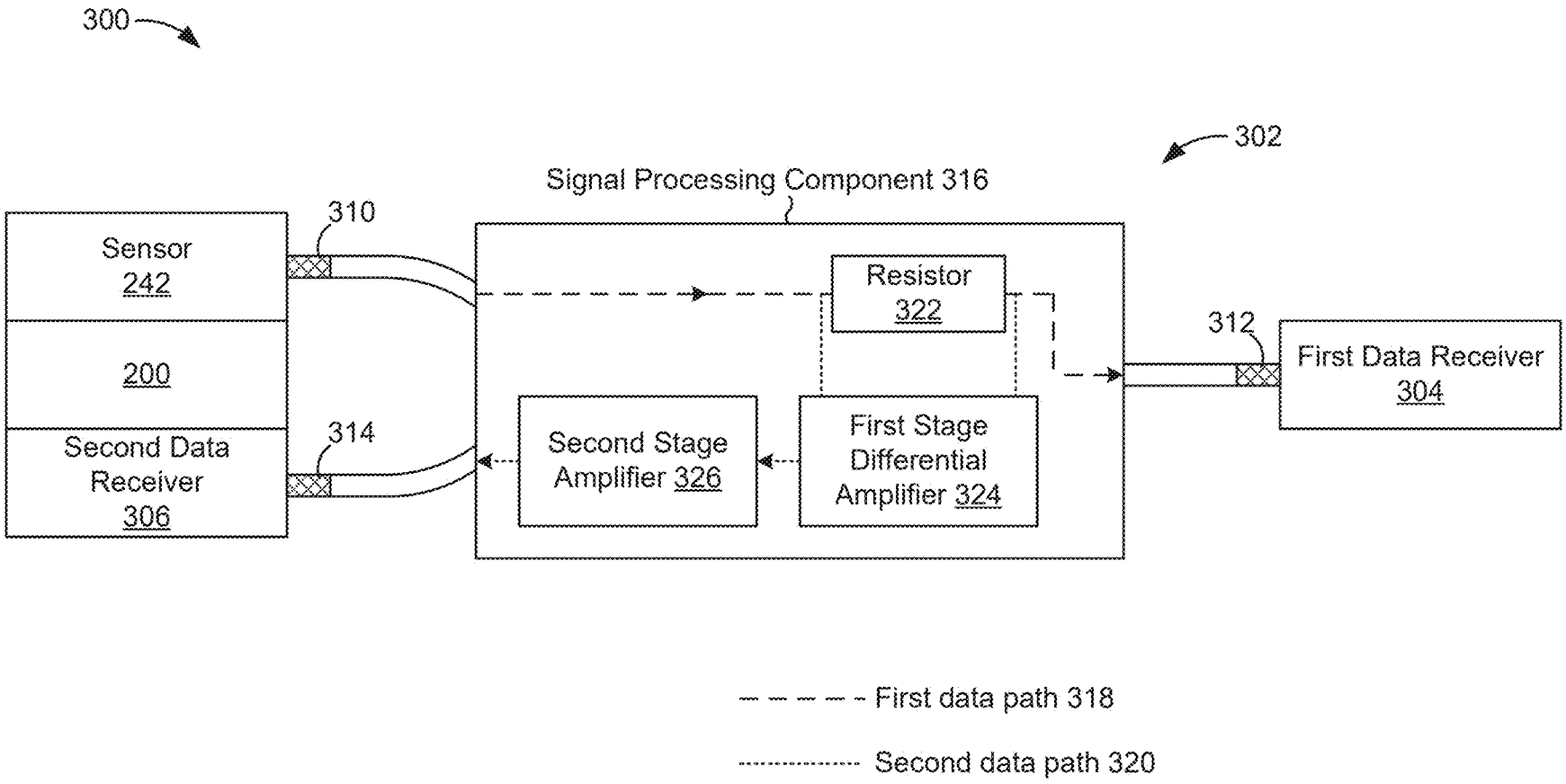
FIG. 3 is a diagram illustrating an example monitoring system for a fluid pump.

FIG. 3 is a diagram illustrating an example monitoring system 300 for the fluid pump 200. The monitoring system 300 includes the sensor 242, a signal distribution device 302, a first data receiver 304, and a second data receiver 306. The first data receiver 304 may be remote from the fluid pump 200, while the second data receiver 306 may be attached to the fluid pump 200. For example, the first data receiver 304 may be a data monitoring system (e.g., data monitoring system 128), such as a data van, located remotely from the fluid pump 200, and the second data receiver 306 may be a pump monitoring unit (e.g., a pump electronic monitoring system) attached to the fluid pump 200. The first data receiver 304 and the second data receiver 306 may include respective controllers or other processing circuitry for receiving and interpreting signals originating from the sensor 242. In some examples, the second data receiver 306 may correspond to controller 130, described in connection with FIG. 1.

In some implementations, the sensor 242 may be powered by the first data receiver 304 (e.g., via the signal distribution device 302). The sensor 242 may be configured to output a signal based on measurements of a parameter relating to the fluid pump 200 (e.g., discharge pressure, suction pressure, oil pressure, or oil temperature, among other examples). The signal may be a current signal. For example, the sensor 242 may be included in a current loop (e.g., that also includes the signal distribution device 302).

The signal distribution device 302 (e.g., a passive, low-power component), without external power, may be coupled to the sensor 242, the first data receiver 304, and the second data receiver 306. For example, the signal distribution device 302 may include a first data port 310 configured to couple to the sensor 242, a second data port 312 configured to couple to the first data receiver 304, and a third data port 314 configured to couple to the second data receiver 306. The signal distribution device 302 may further include a signal processing component 316 that communicatively couples the first data port 310 to the second data port 312 and the third data port 314. For example, the first data port 310 may be communicatively coupled to the second data port 312 via the signal processing component 316, and the first data port 310 may be communicatively coupled to the third data port 314 via the signal processing component 316.

The signal processing component 316 may define a first data path 318 (e.g., an electrical path) between the first data port 310 and the second data port 312, and a second data path 320 (e.g., an electrical path) branching from the first data path 318 to the third data port 314. The first data path 318 may provide a data path from the sensor 242 to the first data receiver 304. The second data path 320 may provide a data path branching from the first data path 318 to the second data receiver 306.

The first data path 318 may include a resistor 322. Accordingly, the signal output by the sensor 242 may pass through the resistor 322 before reaching the first data receiver 304. The resistor 322 may have a low resistance value, such as in a range from 1 ohm to 10 ohms, such that an output of the sensor 242 is not affected (or only insignificantly affected, such as a change of at most ±0.5%) by the resistor 322.

The second data path 320 may include a first stage differential amplifier 324 and a second stage amplifier 326 (e.g., an input of the second stage amplifier 326 is connected to an output of the first stage differential amplifier 324). The first stage differential amplifier 324 and/or the second stage amplifier 326 may be programmable amplifiers. Inputs to the first stage differential amplifier 324 may be connected respectively at an input side of the resistor 322 and at an output side of the resistor 322. The signal processing component 316 may include additional circuitry and/or components (e.g., one or more circuit boards) to effectuate the circuits associated with the first data path 318 and the second data path 320.

When the signal output by the sensor 242 passes through the resistor 322 in the first data path 318, the voltage difference across the resistor 322 (e.g., a difference between an input voltage and an output voltage of the resistor 322) is used to capture the signal in the second data path 320. For example, the first stage differential amplifier 324 may amplify the voltage difference across the resistor 322, and the second stage amplifier 326 may additionally amplify an amplified signal that is output by the first stage differential amplifier 324 for outputting to the second data receiver 306.

Because the resistor 322 has a low resistance value and the voltage difference will likewise be small, the first stage differential amplifier 324 may provide a gain of 10*x* or more. Moreover, a ground signal of the first stage differential amplifier 324 may be electrically isolated from a ground signal of the first data receiver 304. In this way, the first stage differential amplifier 324 provides isolation between the first data receiver 304 and the second data receiver 306 (i.e., the first stage differential amplifier 324 is a differential isolation amplifier). The second stage amplifier 326 may further amplify the amplified signal output by the first stage differential amplifier 324 in order to derive a signal that is the same as (or substantially the same as) the original signal that is output by the sensor 242. For example, the second stage amplifier 326 may provide an additional gain of 10*x* or more to the amplified signal output by the first stage differential amplifier 324.

The original signal that is output by the sensor 242 may have a fixed relationship to a measurement scale (e.g., a measurement scale used for a current loop). The signal's relationship to the measurement scale may indicate the measurements of the parameter collected by the sensor 242. For example, the measurement scale may be from 4 milliamperes (mA) to 20 mA. Where a current of the signal lies on the measurement scale (e.g., from 4 mA to 20 mA) may correspond to a value of the parameter, with signals closer to the low end of the measurement scale representing lower values and signals closer to the high end of the measurement scale representing higher values (or an opposite relationship between signals and the measurement scale in some cases). For example, a 4 mA signal may correspond to a parameter value A, a 5 mA signal may correspond to a parameter value B>A, a 6 mA signal may correspond to a parameter value C>B, and so forth. The particular associations between measurement scale values and parameter values may be referred to as a "definition" of the measurement scale, and the definition of the measurement scale may be fixed, such that the same scale value always indicates the same parameter value.

The first data receiver 304 and the second data receiver 306 are both configured to derive the measurements of the parameter using the measurement scale (e.g., using the definition of the measurement scale). The signal distribution device 302 is configured to distribute respective input signals, based on the signal output by the sensor 242, to the first data receiver 304 and the second data receiver 306, and the input signals may have the same fixed relationship to the measurement scale as the original signal output by the sensor 242. The input signals having the same fixed relationship to the measurement scale as the original signal may mean that the measurements of the parameter collected by the sensor 242 can be derived from the input signals using the measurement scale (e.g., without adjusting the measurement scale and/or the input signals). For example, the input signal to the first data receiver 304 may be the signal output by the sensor 242 that has passed through the resistor 322 in the first data path 318. Because the resistor 322 has a low resistance value, the signal output by the sensor 242 is not affected (or not substantially affected), thereby maintaining the fixed relationship to the measurement scale. As another example, the input signal to the second data receiver 306 may correspond to the voltage difference across the resistor 322 (e.g., which has a correspondence to the signal output by the sensor 242) amplified by the first stage differential amplifier 324 and the second stage amplifier 326 to match the signal output by the sensor 242, thereby also maintaining the fixed relationship to the measurement scale.

Accordingly, proper interpretation of the input signals by the first data receiver 304 and the second data receiver 306 is facilitated by the original signal output by the sensor 242 having an expected relationship to the measurement scale in accordance with the definition of the measurement scale (e.g., if the measurement scale is defined such that a 6 mA signal output by the sensor 242 corresponds to a parameter value A, then the sensor 242 would be expected to output a 6 mA signal when parameter value A is measured). For example, the original signal output by the sensor 242 may have the expected relationship to the measurement scale due to the resistor 322 having a low resistance value. Moreover, the proper interpretation is facilitated by the input signals for the first data receiver 304 and the second data receiver 306 having the same fixed relationship to the measurement scale as the original signal. For example, if the sensor 242 outputs a 10 mA signal, which according to the definition of the measurement scale corresponds to a parameter value X, then each of the input signals are also 10 mA signals (or substantially the same thereof, such as within ±0.5%) that indicate the parameter value X.

Accordingly, the interpretation of the input signals by the first data receiver 304 and the second data receiver 306 can be based on the measurement scale (e.g., 4 mA to 20 mA) without the need for converting the input signals and/or the measurement scale. In this way, the signal distribution device 302 enables multiple data receivers to receive measurements relating to the fluid pump 200 from a single sensor output without modification of the data receivers.

As indicated above, FIG. 3 is provided as an example. Other examples may differ from what is described with regard to FIG. 3.

INDUSTRIAL APPLICABILITY

The signal distribution device 302 described herein may be used with any system that utilizes a sensor for measuring one or more parameters of the system. For example, the signal distribution device 302 may be used with a sensor of a fluid pump, such as a hydraulic fracturing pump, that measures a parameter relating to the fluid pump (e.g., discharge pressure, suction pressure, oil pressure, or oil temperature, among other examples). That is, the sensor and the signal distribution device 302 may be used in connection with diagnostic monitoring of the fluid pump. In some cases, multiple unrelated systems may utilize sensor measurements from the pump, which generally requires the use of respective sensors (and other associated components, such as gauge ports) for each of the systems. However, the use of multiple sensors introduces additional complexity and potential failure points on the pump.

The signal distribution device 302 described herein is useful for distributing a single sensor output (e.g., of a single sensor coupled to a single gauge port) to multiple data receivers (e.g., a data monitoring system remote from the pump and a pump monitoring unit attached to the pump). In particular, the signal distribution device 302 may distribute input signals, based on the single sensor output, to the multiple data receivers without affecting the sensor output and such that a relationship that the input signals have to a measurement scale is the same as the original sensor output's relationship to the measurement scale. In this way, the single sensor output can be used for the multiple data receivers without the need to modify how the data receivers interpret signals (e.g., because the fixed relationship to the measurement scale is maintained), thereby providing improved interoperability with different data receivers. Moreover, by enabling the multiple data receivers to use the single sensor output, the signal distribution device 302 facilitates elimination of additional sensors (and associated gauge ports), thereby reducing complexity and the number of potential failure points on the pump.

The foregoing describes only some embodiments, and alterations, modifications, additions and/or changes can be made thereto without departing from the scope and spirit of the disclosed embodiments, the embodiments being illustrative and not restrictive. Furthermore, implementations are not limited to the disclosed embodiments, and may cover various modifications and equivalent arrangements included within the spirit and scope of the disclosed embodiments. Also, the various embodiments described above may be implemented in conjunction with other embodiments, for example, aspects of one embodiment may be combined with aspects of another embodiment to realize yet other embodiments. Further, each independent feature or component of any given assembly or process may constitute an additional embodiment. As used herein, the singular forms of "a," "an," and "the" include plural referents unless the context clearly dictates otherwise. In addition, as used herein, the term "or" means "and/or" unless the context clearly dictates otherwise.

What is claimed is:

1. A monitoring system for a hydraulic fracturing pump, comprising:

a sensor configured to output a signal based on measurements of a fluid parameter relating to the hydraulic fracturing pump, wherein the signal has a fixed relationship to a measurement scale;

a first data receiver and a second data receiver configured to derive the measurements of the fluid parameter using the measurement scale; and a signal distribution device, without external power, coupled to the sensor, the first data receiver, and the second data receiver, the signal distribution device comprising:

a signal processing component that comprises a resistor in a data path between the sensor and the first data receiver;

a first stage differential amplifier configured to amplify a voltage difference across the resistor; and a second stage amplifier configured to amplify an amplified signal that is output by the first stage differential amplifier, wherein the signal distribution device is configured to distribute respective input signals to the first data receiver and to the second data receiver, and wherein the respective input signals are based on the signal and have the fixed relationship to the measurement scale.

2. The monitoring system of claim 1, wherein the signal distribution device further comprises:

a first data port coupled to the sensor;

a second data port coupled to the first data receiver; and a third data port coupled to the second data receiver, wherein the signal processing component communicatively couples the first data port to the second data port and the third data port.

3. The monitoring system of claim 1, wherein a ground signal of the first stage differential amplifier is electrically isolated from a ground signal of the first data receiver.

4. The monitoring system of claim 1, wherein the signal has an expected relationship to the measurement scale in accordance with a definition of the measurement scale.

5. The monitoring system of claim 1, wherein the fluid parameter is a discharge pressure of the hydraulic fracturing pump, a suction pressure of the hydraulic fracturing pump, an oil pressure of the hydraulic fracturing pump, or an oil temperature of the hydraulic fracturing pump.

6. The monitoring system of claim 1, wherein the signal is a current signal, and the measurement scale is from 4 milliamperes (mA) to 20 mA.

7. The monitoring system of claim 1, wherein the first data receiver is remote from the hydraulic fracturing pump, and the second data receiver is attached to the hydraulic fracturing pump.

8. The monitoring system of claim 7, wherein the first data receiver is a data van, and the second data receiver is a pump monitoring unit.

9. A signal distribution device for a hydraulic fracturing pump, comprising:

a first data port configured to couple to a sensor;

a second data port configured to couple to a first data receiver;

a third data port configured to couple to a second data receiver; and a signal processing component communicatively coupling the first data port to the second data port and the third data port, the signal processing component comprising:

a resistor in a first data path between the first data port and the second data port;

a first stage differential amplifier, in a second data path branching from the first data path, configured to amplify a voltage difference across the resistor; and a second stage amplifier, in the second data path, configured to amplify an amplified signal that is output by the first stage differential amplifier for outputting to the second data receiver.

10. The signal distribution device of claim 9, wherein the signal distribution device is configured to distribute respective input signals to the first data receiver and to the second data receiver, and wherein the respective input signals are based on a signal from the sensor that has a fixed relationship to a measurement scale, and the respective input signals have the fixed relationship to the measurement scale.

11. The signal distribution device of claim 9, wherein the signal distribution device is configured to distribute respective input signals, that are based on a signal from the sensor, to the first data receiver and to the second data receiver without altering an expected relationship of the signal to a measurement scale in accordance with a definition of the measurement scale.

12. The signal distribution device of claim 9, wherein the first stage differential amplifier electrically isolates a ground signal of the first stage differential amplifier from a ground signal of the first data receiver.

13. The signal distribution device of claim 9, wherein the resistor has a resistance value in a range from 1 ohm to 10 ohms.

14. A hydraulic fracturing system, comprising:

a fluid pump;

a gauge port coupled to the fluid pump;

a sensor coupled to the gauge port and configured to output a signal based on measurements of a fluid parameter relating to the fluid pump;

a first data receiver and a second data receiver; and a signal distribution device coupled to the sensor, the first data receiver, and the second data receiver, the signal distribution device comprising:

a first data port coupled to the sensor;

a second data port coupled to the first data receiver;

a third data port coupled to the second data receiver; and a signal processing component that communicatively couples the first data port to the second data port and the third data port, the signal processing component comprising:

a resistor in a data path between the sensor and the first data receiver;

a first stage differential amplifier configured to amplify a voltage difference across the resistor; and a second stage amplifier configured to amplify an amplified signal that is output by the first stage differential amplifier, wherein the signal distribution device is configured to distribute respective input signals to the first data receiver and to the second data receiver, and wherein the respective input signals are based on the signal.

15. The hydraulic fracturing system of claim 14, wherein the gauge port is coupled to a discharge manifold of the fluid pump and the fluid parameter is a discharge pressure of the fluid pump.

16. The hydraulic fracturing system of claim 14, wherein the first data receiver is remote from the fluid pump, and the second data receiver is attached to the fluid pump.

17. The hydraulic fracturing system of claim 16, wherein the first data receiver is a data van, and the second data receiver is a pump monitoring unit.

18. The hydraulic fracturing system of claim 14, wherein the first stage differential amplifier electrically isolates a ground signal of the first stage differential amplifier from a ground signal of the first data receiver.

19. The hydraulic fracturing system of claim 14, wherein the resistor has a resistance value in a range from 1 ohm to 10 ohms.

20. The hydraulic fracturing system of claim 14, wherein the signal distribution device is configured to distribute the respective input signals to the first data receiver and to the second data receiver without altering an expected relationship of the signal to a measurement scale in accordance with a definition of the measurement scale.

* * * * *